US008166991B2

(12) United States Patent
Carter

(10) Patent No.: US 8,166,991 B2
(45) Date of Patent: May 1, 2012

(54) RAIL SKIRT SYSTEM

(76) Inventor: Mark C. Carter, Murieta, CA (US)

( * ) Notice: Subject to any disclaimer, the term of this patent is extended or adjusted under 35 U.S.C. 154(b) by 0 days.

(21) Appl. No.: 13/153,633

(22) Filed: Jun. 6, 2011

(65) Prior Publication Data

US 2011/0232712 A1 Sep. 29, 2011

Related U.S. Application Data

(60) Division of application No. 12/726,515, filed on Mar. 18, 2010, now Pat. No. 7,958,903, which is a continuation of application No. 11/739,621, filed on Apr. 24, 2007, now Pat. No. 7,686,026.

(60) Provisional application No. 60/796,341, filed on Apr. 28, 2006.

(51) Int. Cl.
*E04H 15/46* (2006.01)
*E04H 15/32* (2006.01)

(52) U.S. Cl. ..... 135/144; 135/142; 135/117; 135/120.3; 403/170; 403/217; 248/219.3

(58) Field of Classification Search ..... 135/139–146, 135/121, 117, 120.3, 161; 403/170–173, 403/217–219, 398, 400–402; 248/219.3, 248/227.3, 229.13
See application file for complete search history.

(56) References Cited

U.S. PATENT DOCUMENTS

| | | | | |
|---|---|---|---|---|
| 684,130 | A | | 10/1901 | Taubert |
| 1,326,006 | A | | 12/1919 | Sterhardt |
| 1,493,915 | A | | 4/1924 | Baker |
| 1,712,836 | A | | 5/1929 | Mills |
| 1,728,356 | A | | 9/1929 | Morgan |
| 1,846,011 | A | * | 2/1932 | Adams ..... 135/158 |
| 1,853,367 | A | | 4/1932 | Mace |
| 2,151,908 | A | * | 3/1939 | Gottlieb ..... 135/136 |
| 2,989,329 | A | | 6/1961 | Noah |
| 3,133,549 | A | * | 5/1964 | Severing ..... 135/153 |
| 3,174,397 | A | | 3/1965 | Sanborn |
| 3,182,672 | A | * | 5/1965 | Biller, Jr. ..... 135/117 |
| 3,199,518 | A | | 8/1965 | Gildewell |
| 3,335,815 | A | | 8/1967 | Oakes |
| 3,375,624 | A | | 4/1968 | Mikulin |
| 3,496,687 | A | | 2/1970 | Greenberg et al. |
| 3,526,066 | A | | 9/1970 | Hagar et al. |
| 4,156,433 | A | | 5/1979 | Beaulieu |
| 4,247,216 | A | | 1/1981 | Pansini |
| 4,558,713 | A | | 12/1985 | Hagler et al. |
| 4,601,301 | A | | 7/1986 | Hermanson |
| 4,607,656 | A | | 8/1986 | Carter |
| 4,641,676 | A | | 2/1987 | Lynch |
| 4,779,635 | A | | 10/1988 | Lynch |
| 4,932,354 | A | | 6/1990 | Kestner |
| 4,947,884 | A | | 8/1990 | Lynch |

(Continued)

FOREIGN PATENT DOCUMENTS

FR 2805559 A1 * 8/2001

(Continued)

*Primary Examiner* — Winnie Yip
(74) *Attorney, Agent, or Firm* — Fulwider Patton LLP

(57) ABSTRACT

The rail skirt system includes a top rail, a skirt that hangs from the top rail, formed from rail bar members connected together at their inner ends by a middle connector tube connectable to a locking support leg, to provide support for the top rail on a side of a shelter. The outer ends of the rail bar members are connected to legs of the shelter by fixed corner connecting brackets.

4 Claims, 4 Drawing Sheets

U.S. PATENT DOCUMENTS

| | | | | |
|---|---|---|---|---|
| 5,035,253 | A | 7/1991 | Bortles | |
| 5,244,001 | A | 9/1993 | Lynch | |
| 5,275,188 | A | 1/1994 | Tsai | |
| 5,421,356 | A | 6/1995 | Lynch | |
| 5,485,863 | A | 1/1996 | Carter | |
| 5,490,533 | A | 2/1996 | Carter | |
| 5,634,619 | A | 6/1997 | Alessi | |
| 6,055,999 | A | 5/2000 | Grey | |
| 6,070,604 | A | 6/2000 | Carter | |
| 6,478,039 | B2 | 11/2002 | Suh | |
| 6,502,890 | B1 | 1/2003 | Fliege et al. | |
| 6,508,262 | B1 * | 1/2003 | Takayama | 135/145 |
| 6,718,995 | B2 * | 4/2004 | Dotterweich | 135/131 |
| 6,951,327 | B1 * | 10/2005 | Seo | 248/188 |
| 7,240,685 | B2 | 7/2007 | Seo | |
| 7,240,687 | B2 | 7/2007 | Carter | |
| 2006/0000499 | A1 | 1/2006 | Livacich et al. | |
| 2006/0062632 | A1 * | 3/2006 | Jang | 403/109.6 |

FOREIGN PATENT DOCUMENTS

| | | |
|---|---|---|
| GB | 198803 | 6/1923 |
| GB | 672815 | 5/1952 |

* cited by examiner

RAIL SKIRT SYSTEM

CROSS REFERENCES TO RELATED APPLICATIONS

This is a divisional of U.S. Utility patent application Ser. No. 12/726,515 filed on Mar. 18, 2010, U.S. Pat. No. 7,958,903, which is a continuation of Non-Provisional application Ser. No. 11/739,621, filed on Apr. 24, 2007, U.S. Pat. No. 7,686,026, which is based upon Provisional Patent Application No. 60/796,341, filed Apr. 28, 2006, the entire contents of which are incorporated herein by reference.

BACKGROUND OF THE INVENTION

This invention relates generally to folding, collapsible structures, and more particularly relates to a rail skirt assembly for folding, collapsible structures with legs to which the rail skirt may be mounted.

Temporary shelters that can be easily transported and rapidly set up at emergency sites can be particularly useful in providing temporary care and housing. Such shelters can also be useful for non-emergency outdoor gatherings, such as for temporary military posts, field trips, and the like. It would be desirable to provide a rail skirt for a collapsible shelter for converting a collapsible shelter into an exhibit booth. The present invention fulfills these and other needs.

SUMMARY OF THE INVENTION

Briefly and in general terms, the invention provides for a rail skirt system for a collapsible shelter with a plurality of legs to which the rail skirt is mounted, to provide at least a partially sheltered base portion of the shelter, so as to allow the shelter to be transformed into a booth structure, such as an exhibitor booth.

The rail skirt includes a top rail, and typically includes a skirt that hangs from the top rail. The skirt typically is double sided, and may be formed of a fabric material such as a polyester fabric, for example. The top rail is typically formed from first and second rail bar members that are inserted into a middle connector tube having a middle forked bracket that is connectable to a locking support leg, to provide support for the top rail on a side of the shelter. Each rail bar member includes a locking end with a pair of spring mounted outer detent pins extending from opposing sides of the locking end of the rail bar member. The detent pins are typically mounted on opposing leaf springs secured inside the locking end of the rail bar member. A pair of inner buttons are also mounted on the opposing leaf springs, so that pressing one of the inner buttons depresses the corresponding outer detent pin of the corresponding leaf spring.

The locking support leg includes one end that rests on a floor or ground surface, and a locking end with a pair of spring mounted outer detent pins extending from opposing sides of the locking end of the locking support leg, and the detent pins are likewise mounted on opposing leaf springs secured inside the locking end of the locking support leg. A pair of inner buttons are also mounted on the opposing leaf springs, so that pressing one of the inner buttons depresses the corresponding outer detent pin of the corresponding leaf spring, allowing the locking support leg to connect the opposing outer detent pins in apertures of the middle forked bracket of the middle connector tube of the top rail.

The locking ends of the rail bar members are connected to legs of the shelter with fixed corner connecting brackets having a pair of journal arms pivotally connected together by a pivot pin, and having an open configuration and a closed configuration that clamps to a leg of the shelter. The outer ends of the journal arms have forked ends with apertures that receive the outer detent pins of the locking ends of the rail bar members, allowing the rail bar members of the top rail to be clamped to the legs of the shelter. These and other forms of the invention will become apparent from a consideration of the following detailed description and from the accompanying drawings.

DETAILED DESCRIPTION OF THE PREFERRED EMBODIMENTS

Figure 1:
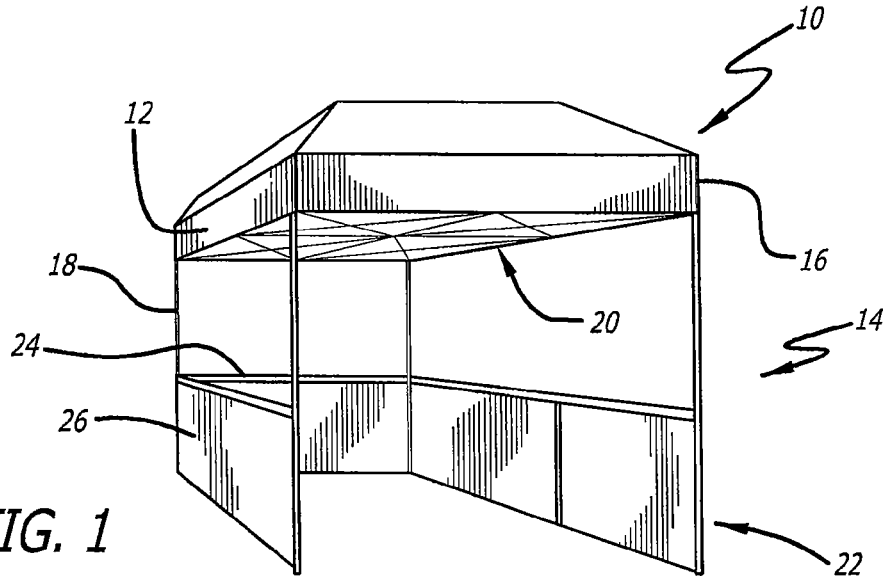
FIG. 1 is a perspective view of a collapsible shelter with a rail skirt system according to the present invention.

Referring to the drawings, a collapsible shelter with a rail skirt system according to the present invention is illustrated in FIG. 1, and typically includes a collapsible shelter 10, including a canopy portion 12 with three or more sides 14, and three or more corners 16. Such a collapsible shelter typically has four sides and four corners. The canopy portion is typically formed of nylon fabric, so as to be light and easily transportable, although the canopy portion may be made of other similar sheet materials, such as canvas, or other types of cloth fabric, or plastic. Legs 18 are typically provided at each corner to support the canopy. A collapsible framework 20, typically including a perimeter truss framework and a central truss framework, is connected to the legs to stabilize and support the collapsible shelter, as is described in U.S. Pat. No. 5,490,533, which is incorporated by reference herein. A rail skirt 22 may be attached to the legs of the collapsible shelter along at least one side of the shelter, and typically along three sides of the shelter, to transform the shelter into a booth structure, such as an exhibitor booth.

The rail skirt includes a top rail 24, and a skirt 26, that can be hung from the top rail, typically double sided and formed of a fabric material such as a polyester fabric, for example. The top rail may be formed from a single rail bar member, but is typically formed from first and second rail bar members 28 having a first inner end 30 that is inserted into a middle hollow connector tube 32 having a middle forked bracket 34 that is connectable to a locking support leg 36, shown in FIG. 5.

Figure 3:
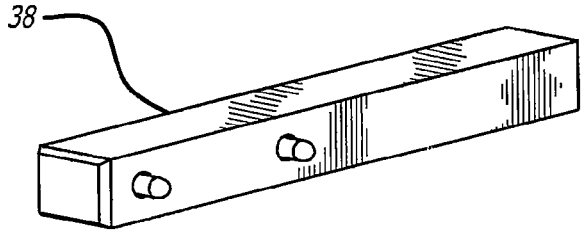
FIG. 3 is a schematic view of a locking end portion of the rail member of the rail skirt system of FIG. 1.
Figure 2:
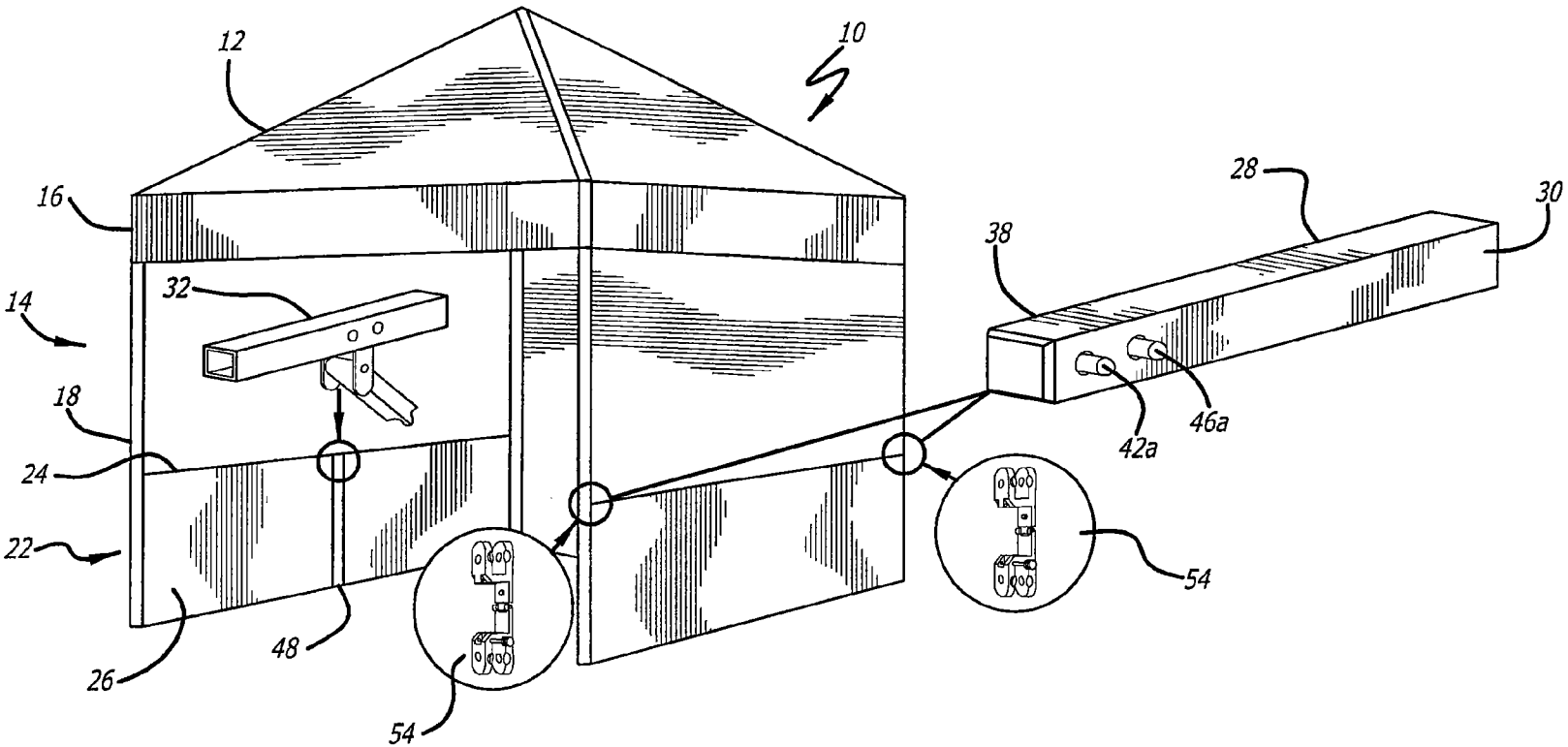
FIG. 2 is another perspective view of a collapsible shelter with a rail skirt system illustrating rail bar members and corner connecting brackets of the rail skirt system of FIG. 1.
Figure 4:
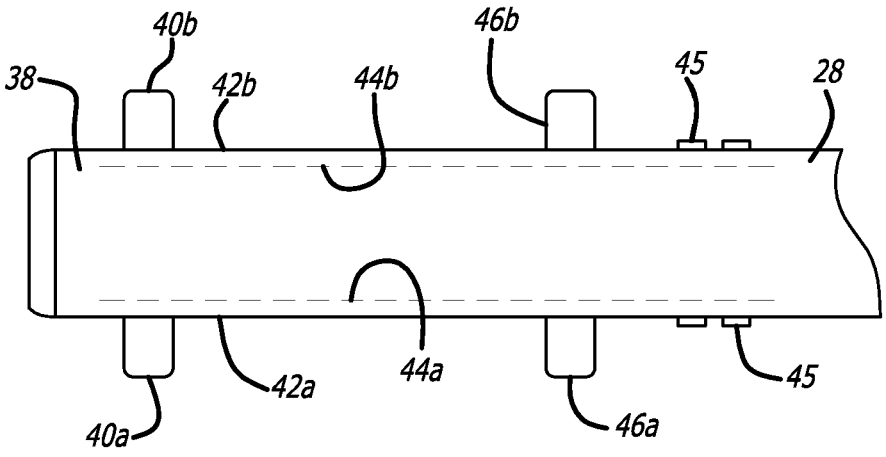
FIG. 4 is a top plan view of the locking end portion of the rail member of the rail skirt system of FIG. 3.

Referring to FIGS. 2-4, each rail bar member includes a second or outer locking end 38 with a pair of spring mounted outer detent pins 40*a*, 40*b* extending from opposing sides 42*a*, 42*b* of the second end of the rail bar member. The detent pins 40*a*, 40*b* are mounted on opposing leaf springs 44*a*, 44*b* secured at one end inside the second end of the rail bar member, such as by rivets 45 or spot welds, for example. A pair of inner buttons 46*a*, 46*b* are also mounted on the opposing leaf springs, so that pressing one of the inner buttons depresses the corresponding outer detent pin of the corresponding leaf spring, and squeezing both inner buttons simultaneously will similarly depress both of the outer detent pins simultaneously, and releasing the inner buttons will cause the outer detent pins to extend outwardly from the rail bar member.

Figure 5:
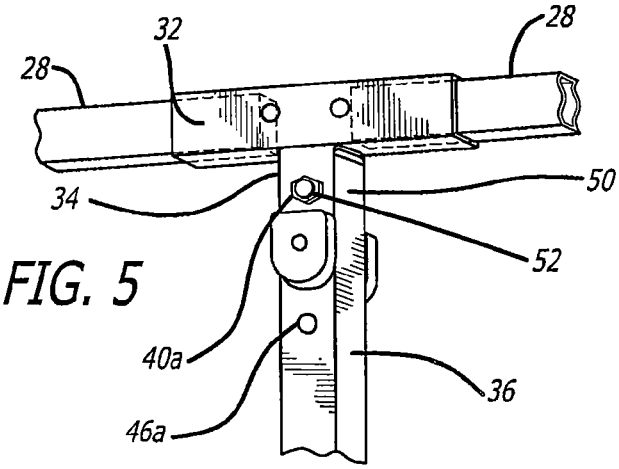
FIG. 5 is a perspective view of a locking support leg of the rail skirt system of FIG. 1.

Referring to FIG. 5, the locking support leg 36 is similar to the rail bar members of the top rail, including a first or bottom end 48 that will rest on a floor or ground surface, and an opposing second locking end 50 with a pair of spring mounted outer detent pins 40*a*, 40*b* extending from opposing sides 42*a*, 42*b* of the second end of the locking support leg, as in the rail bar members discussed above. The detent pins 40*a*, 40*b* are likewise mounted on opposing leaf springs 44*a*, 44*b* secured inside the second end of the locking support leg. A pair of inner buttons 46*a*, 46*b* are also mounted on the opposing leaf springs, so that pressing one of the inner buttons depresses the corresponding outer detent pin of the corresponding leaf spring, and squeezing both inner buttons simultaneously will similarly depress both of the outer detent pins simultaneously, and releasing the inner buttons will cause the outer detent pins to extend outwardly from the locking support leg, allowing the locking support leg to connect the opposing outer detent pins in apertures 52 of the middle forked bracket of the middle hollow connector tube of the top rail.

Figure 6:
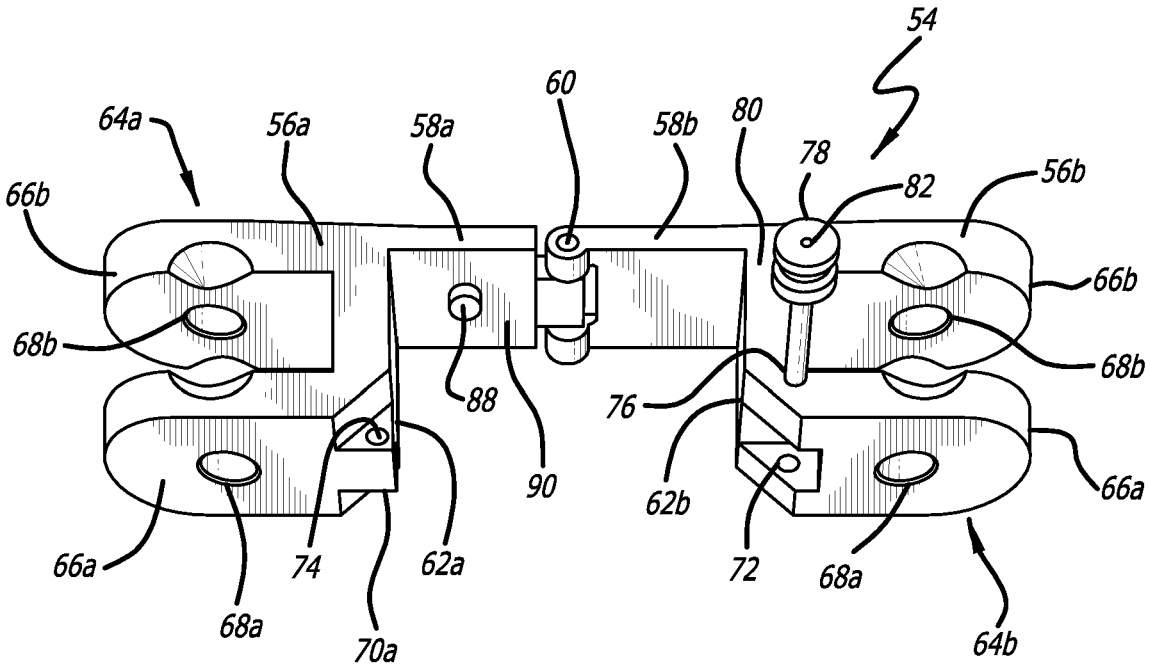
FIG. 6 is a perspective view of a locking corner bracket, shown in an open configuration, for mounting the rail skirt system of FIG. 1 to a collapsible shelter according to the present invention.
Figure 7:
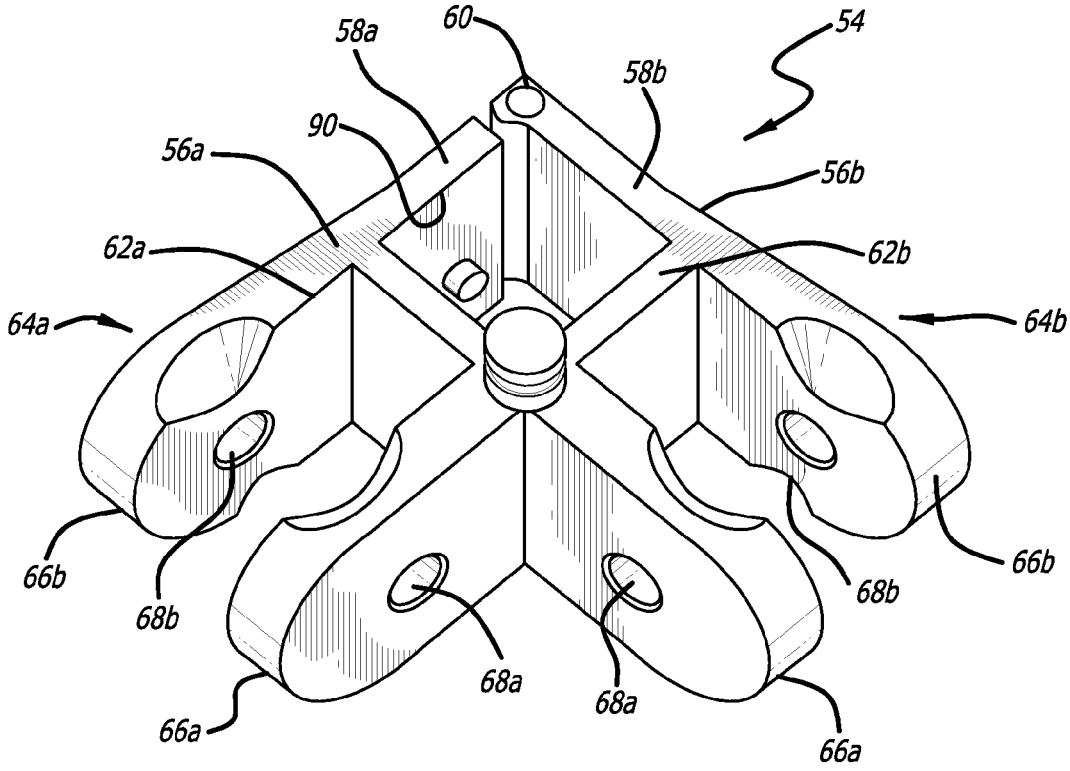
FIG. 7 is a perspective view of the locking corner bracket of FIG. 6 shown in a closed configuration.

Referring to FIGS. 6 and 7, the second or outer locking ends of the rail bar members are connected to legs of the shelter with fixed corner connecting brackets 54. The fixed corner connecting bracket includes first and second hinged bracket portions 56*a*, 56*b* having journal arms 58*a*, 58*b* pivotally connected together by a pivot pin 60. Inner struts 62*a*, 62*b* extend perpendicularly from the journal arms, and forked brackets 64*a*, 64*b* extend from the inner struts 62*a*, 62*b*, respectively, and include first and second connecting arms 66*a*, 66*b* with opposing apertures 68*a*, 68*b* for receiving the outer detent pins of the second ends of the rail bar members. One of the inner struts 62*a* includes a tongue member 70 projecting from the inner strut 62*a*, and the other inner strut 62*b* includes a corresponding groove or slot 72 that receives the tongue member. Extending through the tongue member is a hole 74, that is aligned to mate with a corresponding hole 76 through the portion of the inner strut 62*b* enclosing the groove or slot, when the tongue member is received in the slot, allowing the fixed corner connecting bracket to be locked in a closed configuration, by insertion of a threaded locking pin 78 through the hole 76 through the portion of the inner strut 62*b* enclosing the groove or slot. The threaded locking pin includes a shaft 80 with a head 82 at one end, and threads (not shown) at an opposing end that mates with corresponding internal threads in the hole 76 through the portion of the inner strut 62*b* enclosing the groove or slot. One of the journal arms 58*a* preferably includes a locking tab 88 on the inner surface 90 of the journal arm that is adapted to be received in a corresponding leg mounting hole (not shown) formed in a desired location on a leg of the collapsible shelter. Thus, in an open configuration, the fixed corner connecting bracket may be closed around and attached to the leg of the collapsible shelter.

It will be apparent from the foregoing that while particular forms of the invention have been illustrated and described, various modifications can be made without departing from the spirit and scope of the invention. Accordingly, it is not intended that the invention be limited, except as by the appended claims.

What is claimed is:

1. A corner connecting bracket for a rail skirt system for a collapsible shelter having a plurality of legs, the rail skirt system including a top rail removably connected between an adjacent pair of the plurality of legs, the corner connecting bracket comprising:

first and second hinged bracket portions pivotally connected together and having a closed position configured to clamp to a leg of a shelter, and an open position configured to be unclamped to the leg of the shelter, said first hinged bracket portion including a first journal arm having an inner end and an outer end, said second hinged bracket portion including a second journal arm having an inner end and an outer end, said first journal arm inner end and said second journal arm inner end being pivotally connected together by a pivot pin, said first journal arm including a first inner strut extending perpendicularly from said first journal arm, and said second journal arm including a second inner strut extending perpendicularly from said second journal arm, said first inner strut including a tongue member projecting from said first inner strut, and said second inner strut having a slotted portion including a slot that removably receives said tongue member, said tongue member including an aperture extending therethrough, and said slotted portion of said second inner strut having a corresponding aperture therethrough that is aligned to mate with said aperture through said tongue member when said tongue member is received in said slot; and a locking pin slidably connected to said slotted portion of said second inner strut in said aperture through said slotted portion, said locking pin being configured to extend through said aperture through said tongue member and through said aperture through said slotted portion when said tongue member is received in said slot, thereby allowing said first and second hinged bracket portions to be locked in said closed position.

2. The corner connecting bracket of claim 1, wherein said locking pin is a threaded locking pin including a shaft having a first end with a head and a threaded second end, said threaded second end of the threaded locking pin threadedly mating with said aperture through said slotted portion of said second inner strut.

3. The corner connecting bracket of claim 1, wherein said outer end of said first journal arm includes a first forked end, said outer end of said second journal arm includes a second forked end, said first and second forked ends each including first and second connecting arms with opposing apertures configured to receive outer detent pins of outer locking ends of first and second top rails, allowing the first and second top rails to be clamped to the leg of the shelter.

4. The corner connecting bracket of claim 1, wherein said first journal arm includes a locking tab on an inner surface of said first journal arm, said locking tab being configured to be received in a corresponding mounting hole of the leg of the shelter in said closed position.

* * * * *